United States Patent [19]

Altorfer et al.

[11] 4,206,432

[45] Jun. 3, 1980

[54] ELECTROMAGNETIC RELAY

[75] Inventors: Kurt H. Altorfer, Au; Werner U. Frey, Thalwil, both of Switzerland

[73] Assignee: International Standard Electric Corporation, New York, N.Y.

[21] Appl. No.: 894,265

[22] Filed: Apr. 7, 1978

[51] Int. Cl.[2] ..... H01H 9/02; H01H 13/04

[52] U.S. Cl. ..... 335/202; 335/106; 335/152

[58] Field of Search ..... 335/106, 152, 187, 202, 335/265

[56] References Cited

U.S. PATENT DOCUMENTS

| | | | |
|---|---|---|---|
| 1,876,295 | 9/1932 | Hofgaard | 335/265 X |
| 2,888,532 | 5/1959 | Braumann | 335/265 X |
| 3,171,918 | 3/1965 | Killion | 335/202 X |
| 3,194,918 | 7/1965 | Muscante et al. | 335/202 X |
| 3,544,930 | 12/1970 | Sauer | 335/202 X |
| 4,091,346 | 5/1978 | Nishimura et al. | 335/202 X |

*Primary Examiner*—Fred L. Braun

*Attorney, Agent, or Firm*—John T. O'Halloran; Jeffrey P. Morris

[57] ABSTRACT

The invention relates to a micro relay intended for use in printed circuits provided with two switching-over contacts. The contacts are arranged in the core of the coil, each of the contacts being provided with its own armature fixed on the switching-over spring, thus no motion transfer elements are needed. The contact space is hermetically sealed so that contact properties similar to those of reed relays are achieved both for the make contacts and for the break contacts.

5 Claims, 2 Drawing Figures

ELECTROMAGNETIC RELAY

BACKGROUND OF THE INVENTION

The present invention relates to an electromagnetic relay having contacts arranged within the core of the coil.

Relays are known; the contacts of which are arranged within the core of the coil. There are especially different kinds of relays having reed contacts sealed into a glass tube. These relays exhibit beside a good sensitivity a very good constancy of the contact resistance due to the sealed contact space and due to the absence of any mechanical piece parts subjected to abrasion. Unfortunately, the need of sealing the contact blades brings different problems in the manufacture, i.e., the exact alignment of the contact blades during the sealing process occurring with relatively high temperatures is rather expensive. Further the glass-to-metal seal introduces some dangers in the application since it must be taken care that these seals are not subjected to mechanical stresses as they can occur, e.g., by bending a printed circuit board.

Further it is rather difficult to provide switching over contacts with relays having reed contacts, since in this case the contact blades are subjected to at least partly contradictory requirements with respect to their mechanical and magnetical properties.

SUMMARY OF THE INVENTION

It is, therefore an object of the present invention to provide an electromagnetic relay having the mentioned advantages of the known reed contact relays, but avoiding their drawbacks.

The relay according to the invention is characterized by comprising a coilformer having a space extending in the axis of the coil at least one make contact yoke and one contact spring yoke having fixed thereto a contact sping and fixed to the latter an armature within said space, a magnet clip including an insulating foil to close the magnetic circuit on the outside of the coil and an envelope made from a synthetic resin which is prevented by the magnet clip from penetrating into said space and which hermetically seals the space containing the contacts.

BRIEF DESCRIPTION OF THE DRAWINGS

The invention will be best understood from the following description of an embodiment taken in conjunction with the accompanying drawing in which

In connection with FIG. 1 and 2, a relay provided with two switching-over contacts is described where identical parts are provided with identical references. The relay is designed for the insertion into printed circuit boards where FIG. 2 shows a sectional view of the relay, the sectional plane of which extends in parallel to the not shown printed circuit board through the axis of the coil. In the perspective view of the relay of FIG. 1, the parts belonging to one of the two swtiching-over contacts are assembled into the coilformer, whereas the parts belonging to the other swtiching-over contact are shown outside the coilformer.

DESCRIPTION OF THE PREFERRED EMBODIMENT

Figure 1:
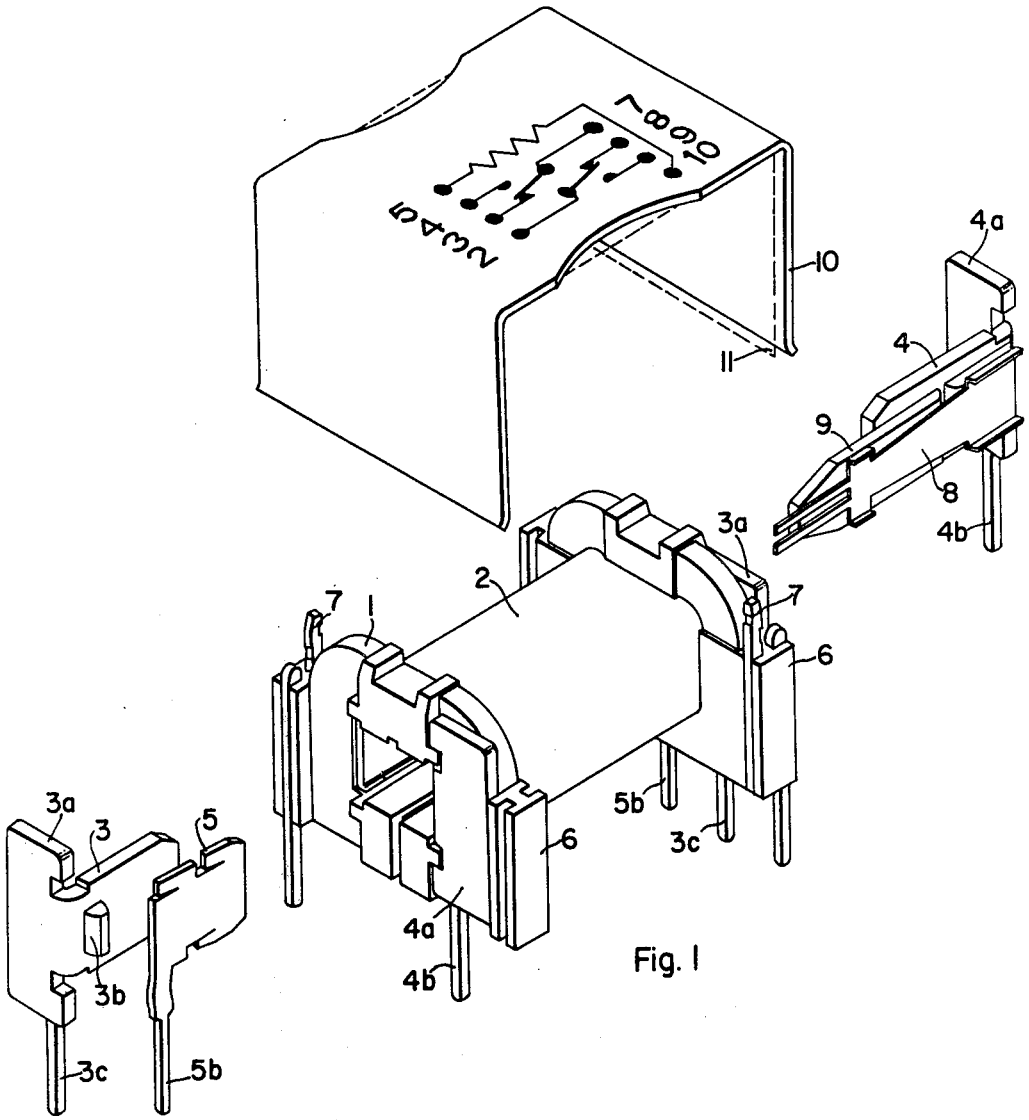
FIG. 1 shows a perspective view of the relay in a partly assembled condition.

A coilformer 1 provided with flanges carries a coil 2. The coilformer 1 is provided with a core opening of rectangular cross-section, including on each of the two larger side-wall, three longitudinal grooves extending over the whole length of the core opening. Two of said grooves are directly adajcent to the smaller side of the rectangular, whereas the third pair of grooves is provided in the middle between the two other pairs. Each lateral groove is intended for the reception of a make contact yoke 3 and a contact spring yoke 4, whereby a yoke 3 and a yoke 4 are inserted from the same side into two different grooves. Into the middle groove a break contact piece 5 is inserted from each of the two sides. The dimension of the grooves and of the pieces to be received therefrom are so designed that the inserted pieces are maintained in a predetermined position without further operations owing to their own elastic deformation (break contact pieces 5) or due to an elastic deformation of the coilformer.

The flanges of the coilformer 1 are provided on their outer side with recesses into which bent portions **3*a* and 4*a* of the yokes 3 and 4 fit so that with introduced yokes a plane surface is provided at the coil flanges. Each coil flange is provided at its ends with two H-like members 6 for the reception of a coil terminal spring 7, which is bifurcated and can be inserted into the groove of each member 6** and which is maintained in the correct position by an enlargement of one leg of the spring.

Figure 2:
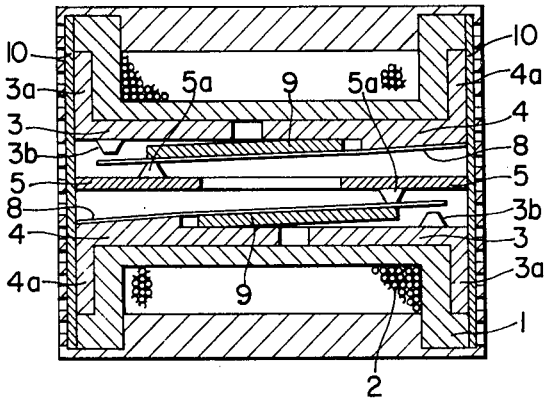
FIG. 2 shows a sectional view of the relay in a plane through the axis of the coil.

On the contact spring yoke 4, there is fixed a swtiching-over spring 8, carrying in its turn an armature piece 9. As it can be seen from FIG. 2, the two yokes 3 and 4 inserted into the same groove have a distance therebetween which is bridged by the armature 9; the distance between the two yokes being so designed that, on the one hand, the leakage flux between the two yokes 3 and 4 is as small as possible; but on the other hand, the armature 9 overlaps the two yokes in a sufficient manner to achieve a high sensitivity of the relay. The magnetic circuit is closed by a U-shaped magnet clip 10, which is provided at the inner side with a thin plastic foil 11. When jokes 3 and 4 and the break contact pieces 5 are in position, the magnet clip 10 with inserted foil 11 is so mounted on the relay that the legs of the U abut against the bent portions **3*a* and 4*a* of the yokes 3 and 4, which form with the remainder of the coil flanges a continuous surface. The foil 11 serves as an insulation since the yokes 3 and 4** are contact portions, i.e., they are on a certain voltage. Simultaneously, the thin foil provides a little but defined air gap having the same effect as the usual residual plate; i.e., it prevents the armature from sticking due to the remanence after the cut-off of the excitation. A further effect of the foil consists in that this foil seals the contact space against the penetration of synthetic resin during the molding operation, as it will be described later on.

The contact-sided end of the switching-over spring 8 is bifurcated to provide the double contact arrangement often requested. As it can be seen from FIG. 2, the switching-over spring 8 abuts against a contact **5*a* mounted on the break contact piece 5 with non-energized coil and abuts against a make contact 3*b* arranged on the make contact yoke 3 when the coil is energized. The bent portions of the yokes 3 and 4 are provided with pin-like extensions 3*c* and 4*b*** extending perpendicularly to the axis of the coil and serving as soldering tabs to connect the contacts with a printed circuit. The break contact piece 5 is provided with a similar extension *5b*. The contacts *3b* and *5a* are provided with a precious metal plating the composition of which is so chosen that gases emerging from the synthetic resin of the envelope has no adverse effect on the contact properties. Further the contacts exhibit such a profile that the welding operation of the contacts on their carriers can be done without the precious metal coating coming into contact with the welding electrode.

The relay provided with all contact pieces and with the magnet clip is laid into a mould filled with a predetermined amount of a curable synthetic resin with the contact pins on the top and it sinks down therein. It is obvious that the magnet clip with the insulating foil seals the contact space; but since the abutting face of the spoil flange consists of some different parts, small gaps exist into which the synthetic resin can penetrate. By the above mentioned manner of moulding, it is achieved that the synthetic resin penetrates simultaneously into all gaps due to the capillary force so that the air present in the contact space cannot escape and a position of equilibrium is achieved between the capillary force and the air pressure in the contact space. When the synthetic resin is cured, there results a hermetically sealed contact space. If by appropriate processing and cleaning methods at the assembly it is secured that the contact space is clean at the moment of the moulding operation, there is obtained a relay exhibiting similarly well properties with respect to the constancy of the contact resistance as known relays with reed contacts. Since each contact is provided with its own armature, no transmission elements made from plastic material are needed for the armature motion, which elements would produce abrasive products which are deposited with preference between the open contacts due to the electrostatic field.

By the present contact arrangement having a symmetry about the vertical axis, i.e., about the axis vertical to the coil axis and vertical to the printed circuit board, there is achieved that the arrangement of the contact-pins is symmetrical with respect to said vertical axis so that no special coding-pins are needed since the insertion of the relay into a printed circuit board can be performed both in a first position and also in a second position, after a rotation by 180° about the vertical axis.

What is claimed is:

1. Electromagnetic relay including contacts arranged within the core of a coilformer, comprising a coilformer having a space extending along the axis of the coil, at least one make contact yoke and one contact spring yoke having fixed thereto a contact spring and fixed to the latter an armature within said space, a magnetic clip including an insulating foil to close the magnetic circuit external to the coil; and an envelope make of a synthetic resin which is prevented by said magnetic clip from penetrating into said space and which hermetically seals the space containing the contacts; and wherein said relay further includes two switching-over contacts, such that the space within the coilformer is of rectangular cross-section, with each of the larger sides of the rectangle being provided with three grooves; and in each of the two lateral grooves a make contact yoke and a contact spring yoke are fixed, at each end of the space being fixed a make contact yoke of one switching-over contact and a contact spring yoke of a second switching-over contact and a break contact piece being mounted at each of the ends of the space in the middle groove.

2. Relay in accordance with claim 1, wherein the yokes and the break contact pieces are fixed within their associated grooves by elastic deformation.

3. Relay in accordance with claim 2, wherein the ends of the make contact yokes and the ends of the contact spring yokes are bent and fit into recesses of said coilformer to provide an overlapping surface for said magnetic clip.

4. Relay in accordance with claim 3, wherein the bent ends of the yokes and the break contact pieces include lateral extensions to provide terminal pins for the relay.

5. Relay in accordance with claim 4, wherein the space containing the contacts is filled with inert gas.

* * * * *